United States Patent [19]

Evans et al.

[11] 4,284,592

[45] Aug. 18, 1981

[54] COMBUSTION INHIBITORS

[75] Inventors: Geoffrey I. Evans, Malvern; Stuart Gordon, Cleobury Mortimer, both of England

[73] Assignee: Imperial Metal Industries (Kynoch) Limited, Birminghem, England

[21] Appl. No.: 112,273

[22] Filed: Jan. 15, 1980

Related U.S. Application Data

[63] Continuation of Ser. No. 674,877, Apr. 8, 1976, abandoned.

[30] Foreign Application Priority Data

Apr. 9, 1975 [GB] United Kingdom ..... 14651/75

[51] Int. Cl.[3] ..... C06B 21/00

[52] U.S. Cl. ..... 264/3 R; 264/3 E; 149/10; 149/11; 149/98

[58] Field of Search ..... 264/3 R, 3 E; 149/10, 149/11, 98; 102/103; 427/407 C

[56] References Cited

U.S. PATENT DOCUMENTS

| | | | |
|---|---|---|---|
| 3,190,776 | 6/1965 | Ender | 149/8 |
| 3,260,631 | 7/1966 | Witz et al. | 149/7 |
| 3,673,287 | 6/1972 | Thies et al. | 102/103 X |
| 3,679,781 | 7/1972 | Olsen et al. | 264/3 E X |
| 3,773,572 | 11/1973 | Thomas | 149/11 |
| 3,889,463 | 6/1975 | San Miguel | 102/103 X |
| 3,958,417 | 5/1976 | Gordon et al. | 102/103 X |
| 3,961,476 | 6/1976 | Wasserman | 102/103 X |
| 3,985,592 | 10/1976 | Hackett et al. | 264/3 R X |
| 3,999,382 | 12/1976 | Clifford et al. . | |
| 4,004,523 | 1/1977 | Clifford et al. . | |

FOREIGN PATENT DOCUMENTS

| | | |
|---|---|---|
| 1255132 | 11/1971 | United Kingdom . |
| 1312576 | 4/1973 | United Kingdom . |
| 1342802 | 1/1974 | United Kingdom . |

*Primary Examiner*—Peter A. Nelson

*Attorney, Agent, or Firm*—Cushman, Darby & Cushman

[57] ABSTRACT

A double base propellant charge is primed with a dimethyl siloxane resin before application of a silicone elastomer inhibitor to the primed surface. There may be a barrier coating, preferably of a polyvinyl acetal resin, between the double base material and the primer.

14 Claims, 4 Drawing Figures

COMBUSTION INHIBITORS

This is a continuation of application Ser. No. 674,877 filed Apr. 8, 1976 and now abandoned.

BACKGROUND OF THE INVENTION

The present invention relates to inhibition of combustion of a surface of a gas producing body, such as a propellant grain or a solid fuel rocket motor or a solid charge for a gas generator.

It is conventional practice to selectively inhibit combustion of solid fuel propellant grains so as to ensure controlled burning of the grain in use. A long-standing problem in this field is to ensure an adequate bond between the propellant and the inhibiting material. The failure of the bond detracts from the control of the burning process, and a substantial failure can result in pressures which will endanger the rocket.

The invention is particularly concerned with inhibition of double base propellants, that is a propellant comprising nitrocellulose and a plasticiser. The latter is usually a liquid nitric ester such as nitroglycerine. The propellant may, however, include additives such as stabilisers, ballistic modifiers, fuels (for example metal particles) and oxidisers (for example ammonium perchlorate).

SUMMARY OF THE INVENTION

In a first aspect, the invention relates to a method of treating a surface of a body of double base gas producing material to enable bonding of an inhibiting material thereto comprising the steps of applying a coating of a first material to said surface and applying a coating of a second material to the first said coating, the first material being selected to bond to the double base material and to resist diffusion of material therefrom to said second material, and the second material being selected to bond to the inhibitor.

The invention may include the step of providing particulate material at the surface to which the second material is applied to facilitate bonding of the second material to the first. The particulate material may be a metal powder, for example aluminium.

The particulate material may be distributed through the first material. Preferably, the coating of the first material is made sufficiently thin to cause the particles to project therefrom. This may be ensured by controlling the concentration of the first material in a solvent in which it is applied to the double base material.

The solvent may be a mutual solvent for the double base material and the first material, and may be such that it does not leach inorganic salts (for example ballistic modifiers) from the double base material. The solvent should be volatile to enable it to be driven off by heating, and the coat thickness of the first material should be such as to facilitate this driving off process. A suitable solvent is tetrhydrafuran. An alternative solvent is ethylene dichloride, but this is not as suitable as tetrahydrafuran. In either case, the solution is preferably applied by brushing or spraying.

The first material is preferably cross-linkable and a cross-linking agent may be incorporated in the solution before it is applied. The first material may be a polyvinyl acetal resin, for example polyvinyl formal. The first material should be cross-linkable at a temperature above ambient, say at 60° C.

Where the inhibitor is a silicone elastomer, the second material may comprise a silicone resin for example a dimethyl siloxane resin. The resin may be provided in combination with a small proportion of ethyl silicate in a suitable solvent. The material may be treated, if necessary, as further outlined below.

In a second aspect, the invention relates to a method of bonding a silicone elastomer inhibitor to a surface of a body of double base gas producing material comprising the step of applying, directly or indirectly, to said surface a coating of a silicone resin primer. Where the primer is applied indirectly, there may be an intervening barrier coat as discussed above.

In a preferred method according to this aspect of the invention, after said primer has been applied, a coating of a liquid, silicone elastomer inhibitor is applied thereto so that the primer cross-links with the inhibitor while the latter is cross-linking to form a solid coating.

The silicone resin primer may be applied in a solvent, which is preferably a non-solvent for inorganic salts in the propellant, and a non-solvent for a barrier material where the latter has been applied. A suitable solvent is toluene or iso-propanol.

Where the primer comprises dimethyl siloxane resin, as discussed above, it may be treated, if necessary, to remove higher alcohols such as butanols. Further, the resin is preferably formed by hydrolysis of a mixture of di- and tri-functional chlorosilanes. In this case, the proportions of di- and tri-functional components are preferably controlled to lie in the range 92:8 to 94:6 by weight.

Water is preferably present during cross-linking of the inhibitor. This may be ensured by adding water direct to the inhibitor, or by permitting the cross-linking reaction to occur in a humid atmosphere, so that water diffuses from the atmosphere to the interface via the coating of inhibitor.

The silicone elastomer of the inhibitor may be polymethyl siloxane polymer. The polymer may be applied with a cross-linking catalyst which is preferably slow-acting. Suitable cross-linking catalysts are dibutyl tin dilaurate and lead octoate. The same catalysts may be used to induce cross-linking of the primer.

In a third aspect, the invention provides a method of coating a body of gas producing material with an inhibitor comprising the steps of providing a substantially predetermined quantity of curable, liquid inhibitor in a mould, and forcing said body into the mould with a predetermined intervening space between the body and a surface defining the mould interior so as to force the inhibitor into said intervening space, and permitting the inhibitor to at least partially cure before removing the body from the mould, the inhibitor and said surface being mutually releasable.

This aspect of the invention also provides an apparatus for use in performing the method outlined above comprising a mould and guide means to guide the body into the mould with a predetermined intervening space between the body and said surface.

The surface may be provided by a liner which is removable from the mould.

Where the body is tubular, the guide means may comprise a member adapted to enter the longitudinal bore in the body. The guide means may further comprise a surface on the mould adapted to co-operate with a guide removably connected to the body in use. The removable guide may be in the form of a spider having surfaces arranged for sliding contact with the guide surface on the mould. Where the body is tubular, the removable guide may comprise an expandible member adapted for expansion within the bore in the body to engage the body for connection thereto.

Where the body is solid, the guide means may comprise removable track members which can be removably located between the body and the mould during movement of the body into the latter.

The rate at which the body is forced into the mould should be sufficiently slow to avoid trapping air pockets in the liquid inhibitor. There may be fluid pressure operated means arranged to force the body into the mould at a controlled rate.

BRIEF DESCRIPTION OF THE DRAWINGS

By way of example, a method and apparatus for coating a tubular propellant grain with a silicone elastomer inhibitor will now be described with reference to the accompanying drawings, in which.

DESCRIPTION OF THE PREFERRED EMBODIMENT

The tubular grains to be coated by means of the method and apparatus now to be described comprise nitrocellulose with nitroglycerine as a plasticiser. They may be produced by a casting process, for example as described in our prior British Pat. Nos. 1,232,923 and 1,179,415. Following formation of the solid grain, the process of bonding an inhibitor layer to the outer cylindrical surface thereof comprises three stages, namely:

1. Formation of a "barrier" coat on the outer surface of the grain,
2. Formation of a primer coat over the barrier coat, and
3. Formation of the silicone elastomer inhibitor over the primer coat.

Figure 1:
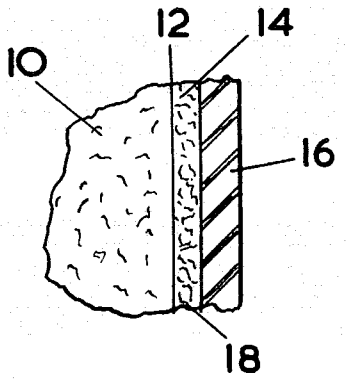
FIG. 1 is a diagrammatic partial section through a region of the bond between a propellant grain and an inhibitor layer.

The resultant arrangement can be seen in FIG. 1 in which numeral 10 indicates an edge portion of the propellant grain, numeral 12 indicates the barrier coating, numeral 14 the primer coating and numeral 16 the inhibitor coating. As indicated 18 in this Figure, aluminium particles are incorporated in the primer coating 12 in such a way as to bridge the interface between that coating and the primer 14. The purpose of these particles, and their incorporation between the coats 12 and 14, will be discussed further below.

The barrier coat forms a bond with the propellant material, and resists diffusion of nitroglycerine (and additives such as propellant stabilisers) to the primer. In the embodiment to be described below, it also provides a particularly suitable surface to receive the primer material. The latter assists bonding of the inhibitor to the barrier coat. The inhibitor acts in the conventional manner to control combustion of the grain in use. The three stages outlined above will now be discussed individually in sequence.

Barrier Coating

The barrier coating comprises polyvinyl formal in tetrahydrafuran as a solvent. Methyl methoxy uron is included in the solution as a cross-linking catalyst for the polyvinyl formal. Aluminium powder is distributed through the solution for a purpose to be described further below.

The solution is applied to the outer cylindrical surface of the grain by brushing, after that surface has been degreased. The solvent is then driven off by heating, and the polyvinyl formal is cross-linked to a solid coating during this heating stage.

A suitable mixture comprises the following proportions by weight:

tetrahydrafuran: 100 parts;
aluminium powder: 10 parts;
polyvinyl formal: 5 parts;
methyl methoxy uron: 0.25 parts.

The tetrahydrafuran is a mutual solvent for the propellant and the polyvinyl formal. However, it tends to leach nitroglycerine from the propellant. Accordingly, it is desirable to apply the barrier coat in one operation, for example by brushing or by spraying. Repeated dipping of the grain is undesirable. The solvent is volatile and can be driven off by heating at about 60° C. To ensure that all of the solvent is driven off, however, it is desirable to use only a thin coating of polyvinyl formal. The coating thickness can be controlled by controlling the concentration of polyvinyl formal in the solution.

The aluminium powder provides a metal surface which enhances adhesion of the primer coat subsequently applied. The particle sizes of the aluminium are preferably large enough in relation to the thickness of the polyvinyl coating to ensure that the particles will project from the coating. The polyvinyl formal concentration indicated above gives a coating thickness of approximately 0.003", and suitable particle sizes for the aluminium powder are as follows- Retained on 120 mesh sieve—nil
Retained on 200 mesh sieve—8% maximum
Retained on 240 mesh sieve—15% maximum
Specific surface area—3000-5000 $cm^{-1}$ Cross-linking of the polyvinyl formal improves its resistance to diffusion from the propellant, and dissolving of the barrier coat by the nitroglycerine. The cross-linking reaction is preferably initiated above ambient temperature, for example at about 60° C. With the solution composition set out above, and heating of the coating at 60° C., a minimum of 12 hours is required to ensure full cross-linking of the polyvinyl formal. The reaction will normally be complete within 24 hours. An alternative solvent for the polyvinyl formal is ethylene dichloride, but this has not been found as satisfactory as tetrahydrafuran. An alternative cross-linking catalyst is titanium acetyl acetonate. The proportions of the various constituents may be varied as required; for example, increase of the proportion of polyvinyl formal provides a thicker coating for a given surface area to be coated; the proportion of aluminium powder may be increased to approximately 30 parts; the quantity of cross-linking agent may be adjusted to provide the required curing time.

Primer Coating

The preferred primer coating is based on dimethyl siloxane polymer. It is known to cure such polymers using ethyl silicate as a cross-linking agent—see for example "Rubber Technology" edited by Maurice Morton published by Van Nostrand Reinhold Company 2nd edition pages 403–4. Such systems have been found generally satisfactory for primers according to the invention, but certain conditions must be satisfied as outlined below.

Dimethyl siloxane resins are conventionally formed by hydrolysis of selected chlorosilanes in an aqueous-/alcohol medium. It has been found that the higher alcohols, such as butanols, are deleterious to bonding in the present context, and they must be reduced to trace quantities in the primer used in this case.

The chlorosilanes used in the hydrolysis step may be of the di-functional or the tri-functional type, and it is important to carefully control the proportion of tri-functional chlorosilanes in the hydrolysed mixture. The weight proportion of tri-functional chlorosilane in the mixture may be in the range 6–8%. Excessive presence of tri-functional chlorosilanes impairs bonding and a deficiency impairs formation of an adequately cross-linked resin.

The primer is applied by brushing on a solution. The solvent for the primer must be a non-solvent for the barrier coat and for salts in the propellant. Toluene and iso-propanol are suitable solvents for the resin discussed above. A suitable cross-linking catalyst, such as dibutyl tin dilaurate or lead octoate, is added in the proportion of approximately 0.2% by weight.

The applied primer is dried by leaving it to stand in air at a temperature in the range 15°–30° C., say 20° C. The drying period should be a minimum of 12 hours, and drying will normally be complete within 24 hours. If required in order to ensure a complete coating of the grain, a second application may be made in the same way.

Inhibitor Coating

The inhibitor material is a liquid polymethyl siloxane polymer with or without filler material. A slow rate cross-linking catalyst is added to the polymer, a maximum of one hour prior to the formation of the inhibitor coating. The catalyst is added in the proportion 0.2% by weight. Suitable cross-linking catalysts are dibutyl tin dilaurate and lead octoate. A suitable polymer is supplied by Imperial Chemical Industries under the name "Silcoset 105".

The coating is formed by one of the methods discussed further below involving moulding of the liquid polymer around the outer surface of the grain. The polymer is partially cross-linked while in the mould to form a self-supporting coating on the grain. The coated grain is then removed from the mould and permitted to stand in a humid atmosphere for a period sufficient to ensure full cross-linking of the inhibiting polymer and formation of an adequate bond with the primer coating.

Assuming that the coating has been permitted to cure for approximately 24 hours in the mould, a curing period of at least 5 days in an atmosphere of 70% relative humidity should enable full cross-linking of the inhibitor material and completion of the bond with the primer coating. If the relative humidity is less than 70%, a longer curing period will be required. The temperature during the curing period is preferably in the range 15°–30° C.

One method of forming the coating is to locate the primed grain in a suitable mould with a space left between the grain and the mould. The polymer, to which the cross-linking agent has been added, is then pumped into this space, and left to partially cross-link as described above. However, the preferred method of forming the coating is to provide a predetermined quantity of inhibitor material in a mould, and to force the grain into the mould to displace the inhibitor material to form the required coating. This method will now be described with reference to FIGS. 2 to 4.

Figure 2:
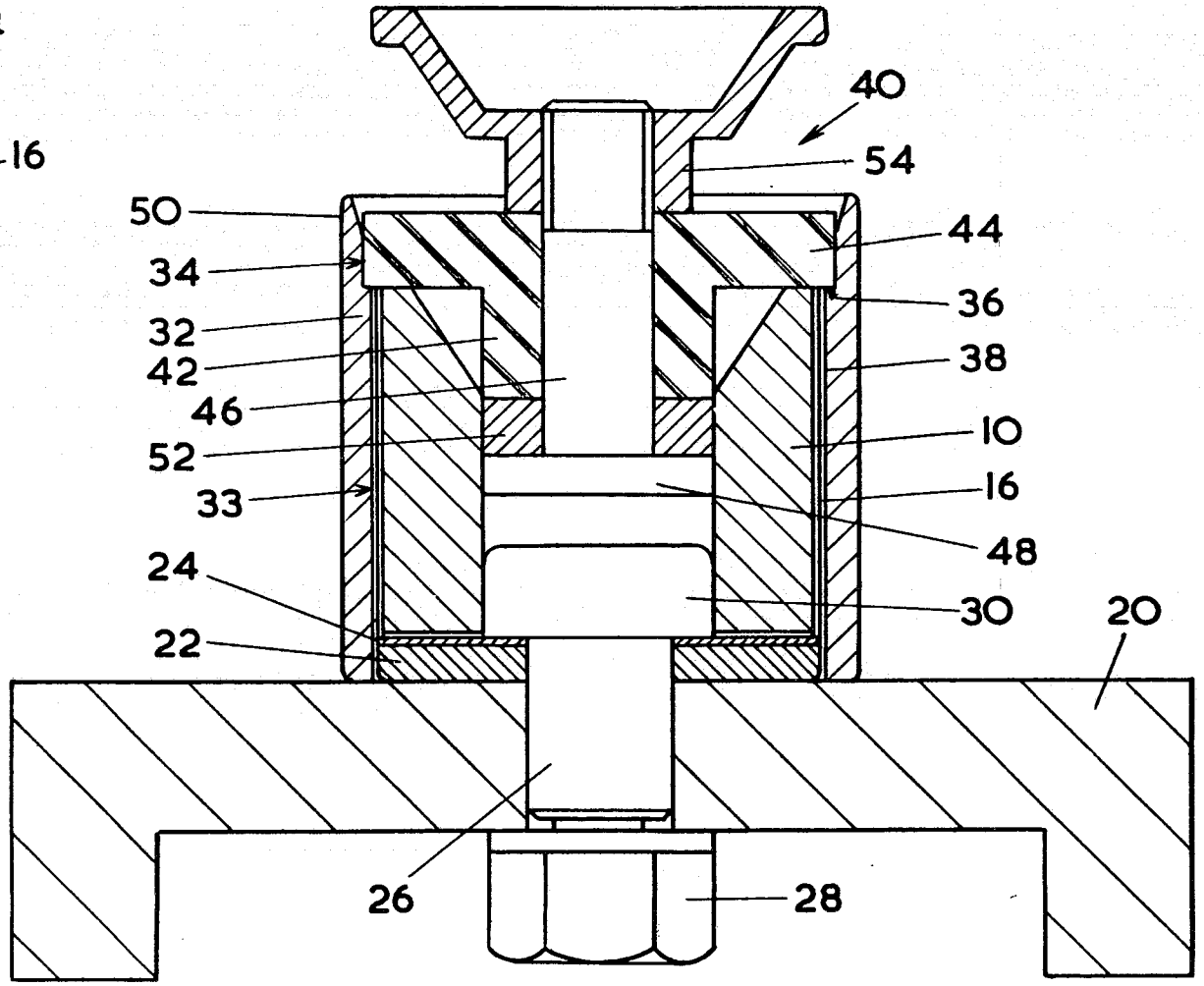
FIG. 2 is a sectioned elevation of a mould apparatus for use in coating the grain with the inhibitor.
Figure 3:
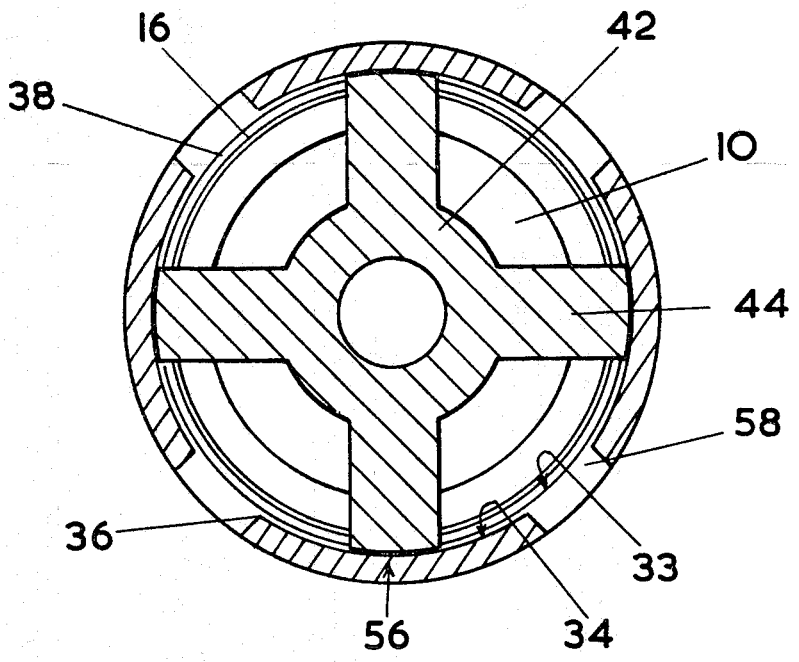
FIG. 3 is a section on the line III—III of FIG. 2.

FIG. 2 shows a mould at the completion of formation of the inhibitor coating, that is, with the charge 10 fully inserted. The mould structure is mounted upon a base 20, and comprises a spacing washer 22 provided with a polythene facing washer 24 to provide the floor of the mould. The washers 22, 24 are clamped to the support 20 by bolt 26 passing through an opening in the support to co-operate with nut 28. The head 30 of the bolt provides a central guide for the hollow charge 10, as will be described further below.

The mould structure further comprises a tubular metal wall 32, the internal face of which is machined to carefully controlled dimensions. This internal face comprises a first portion 33 of relatively small diameter, and further portions 34 of relatively large diameter joined by a ledge 36. The lower surface portion 33 is fitted in use with a polythene liner 38 which provides one surface against which the inhibitor coating is to be moulded. The lower edge of this liner is located in use between the washers 22,24 and the lower edge of the metal wall 32. The upper surface portions 34 provide guide surfaces to co-operate with a guide member attached to the charge 10, as will now be described.

The charge 10 is fitted with a handling device generally indicated by the numeral 40. This device comprises a central tube 42 formed at one end with a spider 44. A spindle 46 extends longitudinally through the tube 42 and is provided at one end with an outwardly extending flange 48 and at the other with a screw-threaded portion 50. A resilient washer 52 is located between flange 48 and the adjacent end of tube 42, and a nut 52 is fitted onto the end of portion 50 projecting from the tube. As the member 52 is compressed by suitable rotation of the nut 54, it is squeezed radially outwardly beyond its normal alignment with the outer peripheries of the flange 48 and tube 42. These latter are dimensioned to permit their insertion into the central opening of a charge 10 when the resilient member 52 is uncompressed, the member thereupon being compressible to frictionally engage the inner wall of the charge 10. The charge can then be handled by means of the device 40 without manual contact with its outer surface. The device 40 therefore provides a handle by means of which the charge can be oriented during the application of the barrier and primer coats as discussed above, and during preliminary insertion of the charge into the mould, as discussed below.

When a mould has been assembled in the manner described above with a suitable polythene liner 38, a predetermined quantity of inhibitor material, to which the cross-linking agents has been added, is dispensed into the mould. For example, the quantity dispensed may come close to the upper edge of the bolt head 30. The charge 10 is then inserted into the mould by means of the handle 40, and is located with its central passage just engaging the upper edge of the bolt 30, thereby centralising the lower part of the charge 10 relative to the surrounding facing liner 38. The lower portions of the outer edge surfaces 56 (see FIG. 3) of the spider arms 44 will now engage corresponding surface portions 34 on the upper edge of the wall 32, thereby centralising the upper part of the charge 10. The charge is now forced down into the mould by means of a fluid-operated ram as will be described further below. The inhibitor material in the lower part of the mould is therefore displaced in the reverse direction to the charge into the annular space defined between the outer surface of the charge 10 and the liner 38. The forcing operation continues until the underside of each spider arm 44 engages the ledge 36 on the wall 32. This defines the spacing between the lower edge of the charge 10 and the polythene washer 24 at the base of the mould. Any excess inhibitor material flows out of the cut-away portions 58 (FIG. 3) provided at the upper edge of the wall 32. The inhibitor material remaining in the wall accurately defines a coating on the charge 10. This coating can be accurately controlled to a thickness of 1 mm.

The completed coating is permitted to partially cure as described above. When it has become self-supporting, the charge 10 can be removed from the mould. For example, the mould assembly could be released from the base 20 by removing nut 28, and then the charge 10, liner 38, washers 22,24 and bolt 26 could be forced through the wall 32 to remove them therefrom. The liner 38 can then be peeled off the charge 10, and the latter should be readily releasable from the washer 24 and the bolt head 30. Alternatively, the wall 32 could be formed with means for co-operation with a suitable gripping element (not shown) so that the wall can be drawn away from the base 20, leaving the charge standing on the washer 24 which remains clamped to the base 20. The peeling operation can then be effected as before.

Figure 4:
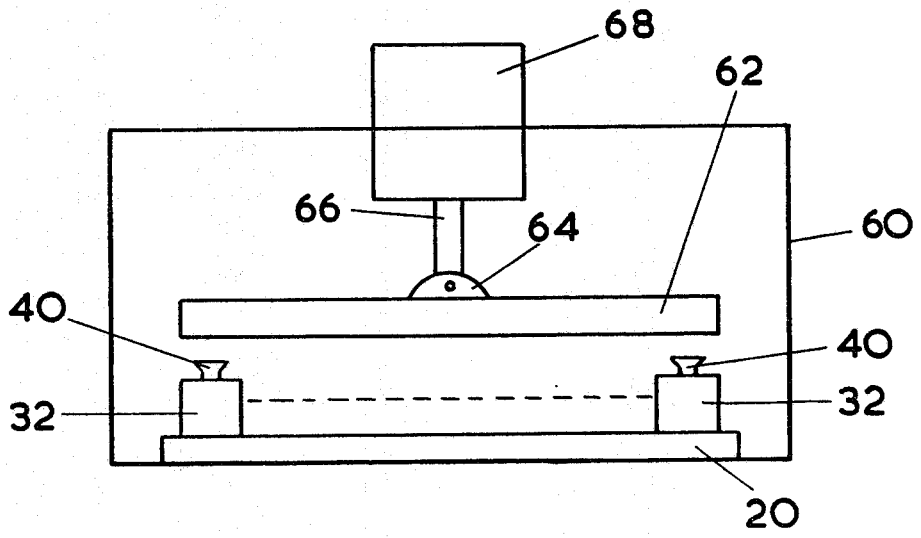
FIG. 4 is a diagrammatic elevation of fluid operated means for forcing a plurality of propellant grains into their respective moulds to form the inhibitor coating.

The forcing operation is effected by a fluid pressure operated device diagrammatically illustrated in FIG. 4. As seen in that Figure, the base 20 is elongated and carries a plurality of mould assemblies individually clamped thereto. When each mould assembly has received a charge 10 manually inserted therein with its spider engaging the guide surfaces at the upper edge of its respective wall 32, the base 20 is located on a floor portion of a frame 60. The moulds are aligned with a bar 62 pivotally connected at 64 to a ram 66. The cylinder 68 of the ram is mounted on the frame 60, and the arrangement is such that the bar 62 can be moved towards and away from the floor of the frame 60 at a controlled rate. Accordingly, the bar 62 can engage the handle 40 on each of the charges carried by the support 22, and force the charges into their respective moulds at said controlled rate. This rate is selected to avoid trapping air pockets in the inhibitor material. A suitable rate can be determined in dependence upon the material being used, and the dimensions of the coating to be formed.

If a solid charge were to be coated, it could be handled by means of a suction device co-operating with one end thereof. Removable elongate track members could then be extended into the mould at intervals spaced around the axis thereof. The solid charge could then be forced into the could, being spaced from the walls thereof by the removable track members. The latter would be gradually removed as the inhibitor material is forced back towards them.

For convenience, it is preferred that both the primer and the inhibitor are provided by room temperature vulcanising polymers. However, the invention is not limited to this type of polymer.

We claim:

1. A method of priming a body of gas producing material comprising nitrocellulose and an energetic nitric ester plasticiser therefor to facilitate bonding a silicone elastomer combustion inhibitor to a surface thereof which is to be inhibited, said method comprising the steps of:

(a) coating said surface with a solution of a polyvinyl acetal, said solution containing a cross-linking agent and having dispersed therein a particulate metal, and causing or allowing the coating to cure, (b) applying to the coating formed in step (a) a coating of a solution of a siloxane resin, said resin having been formed by hydrolysis of a mixture comprising 92–94% by weight of difunctional chlorosilanes and 6–8% by weight of trifunctional chlorosilanes, said solution containing a cross-linking agent for the resin, and causing or allowing the coating to cure.

2. A method according to claim 1, wherein said polyvinyl acetal is a polyvinyl formal.

3. A method according to claim 2, wherein the solution used in step (a) is a solution of a polyvinyl formal in tetrahydrofuran.

4. A method according to claim 2 or claim 3, wherein the cross-linking agent for the polyvinyl formal is selected from methyl methoxy uron or titanium acetylacetonate.

5. A method according to claim 1, wherein said particulate metal is powdered aluminium.

6. A method according to claim 1, wherein the solution used in step (a) comprises about 100 parts by weight tetrahydrofuran, about 10 parts by weight aluminium powder, about 5 parts by weight polyvinyl formal and about 0.25 parts by weight methyl methoxy uron.

7. A method according to claim 1, wherein the siloxane resin applied in step (b) is applied in solution in a solvent selected from toluene or isopropanol.

8. A method according to claim 1, wherein the cross-linking agent for the siloxane resin is selected from dibutyl tin dilaurate or lead octoate.

9. A method according to claim 1, wherein said silanes used in step (b) are methyl chlorosilanes.

10. A method of inhibiting combustion of a body of gas producing material comprising nitrocellulose and an energetic nitric ester plasticizer therefor comprising the steps of priming the surface thereof to be inhibited by the method of claim 1 and applying a layer of a silicone resin inhibitor to the primed surface.

11. A method according to claim 10, wherein the inhibitor layer is applied to said primed surface in the form of a liquid siloxane polymer containing a cross-linking agent and the layer is then caused or allowed to cure.

12. A method according to claim 10 wherein said siloxane polymer is a polymethyl siloxane resin.

13. A combustion inhibited gas-producing material when made by the method according to claim 10.

14. A rocket motor including, as propellant, a combustion-inhibited gas-producing material according to claim 12.

* * * * *